US012703994B2

(12) United States Patent
Heritage et al.

(10) Patent No.: US 12,703,994 B2
(45) Date of Patent: Aug. 11, 2026

(54) BARRIER HEIGHT EXTENDER

(71) Applicant: Barrette Outdoor Living, Inc., Middleburg Heights, OH (US)

(72) Inventors: Christopher J. Heritage, Swedesboro, NJ (US); Christopher Michael Schneider, Linwood, NJ (US)

(73) Assignee: Barrette Outdoor Living, Inc., Middleburg Heights, OH (US)

( * ) Notice: Subject to any disclaimer, the term of this patent is extended or adjusted under 35 U.S.C. 154(b) by 314 days.

(21) Appl. No.: 18/496,381

(22) Filed: Oct. 27, 2023

(65) Prior Publication Data

US 2024/0141682 A1 May 2, 2024

Related U.S. Application Data

(60) Provisional application No. 63/420,434, filed on Oct. 28, 2022.

(51) Int. Cl.
*E04H 17/14* (2006.01)

(52) U.S. Cl.
CPC ..... *E04H 17/1452* (2021.01)

(58) Field of Classification Search
CPC ..... E04H 17/1417; E04H 17/1426; E04H 17/1439; E04H 17/1452; E04H 17/16; E04H 17/1602; E04H 17/165; E04H 17/1488; E04H 17/24; E04H 17/14; E04H 17/166; E04H 17/003; E04H 17/1421; E04F 2011/1823; E04F 2011/1825; E04F 2011/1829; E04F 11/1836; E04F 11/1817
USPC ..... 256/24, 650.1, 11, 21, 22, 19, 12, 17, 256/65.14, 65.15, 65.16, 65.01; 119/52.3
See application file for complete search history.

(56) References Cited

U.S. PATENT DOCUMENTS 4,805,879 A * 2/1989 Spera ..... E04F 11/181 256/22
6,969,051 B1 * 11/2005 Gibbs ..... E04H 17/1439 256/65.01
7,731,160 B2 * 6/2010 Terrels ..... E04F 11/1836 256/65.06
7,992,841 B2 * 8/2011 Petta ..... E04F 11/1817 24/593.1
9,500,001 B2 11/2016 Sherstad
(Continued)

*Primary Examiner* — Amber R Anderson
*Assistant Examiner* — Zachary A Hall
(74) *Attorney, Agent, or Firm* — John Maldjian, Esq.; Stevens & Lee PC

(57) ABSTRACT

Devices for extending the height of a barrier are provided. The devices comprise an elongate member having a downward-facing rail channel comprising a plurality of opposed longitudinal projections extending inwardly into the rail channel, a decorative accent feature mounted on the top surface of the elongate member and extending upwardly therefrom, and a top rail mounted onto a top surface of the decorative accent feature. The devices are configured for downward installation onto the top rail of a barrier panel, whereby a first pair of the opposed longitudinal projections rest on any upwardly facing surface of the top rail, while at least one further pair of the opposed longitudinal projections contacts the opposing side-facing surfaces of the top rail. Also provided are systems comprising these devices, as well as methods for installing these systems onto the top rail of a barrier panel.

20 Claims, 9 Drawing Sheets

(56) References Cited

U.S. PATENT DOCUMENTS

| | | | | |
|---|---|---|---|---|
| 9,797,158 | B2 * | 10/2017 | Springborn | E04F 11/1817 |
| 2014/0021423 | A1 * | 1/2014 | Zen | E04F 11/1817<br>256/65.13 |

* cited by examiner

BARRIER HEIGHT EXTENDER

CROSS-REFERENCE

This application claims benefit and priority to U.S. Provisional Application Ser. No. 63/420,434, file Oct. 28, 2022, entitled, "BARRIER HEIGHT EXTENDER" which is incorporate herein by reference in its entirety.

FIELD OF THE INVENTION

The present disclosure relates generally to devices for extending the height of a barrier, systems comprising such devices, and methods of installing such systems.

BACKGROUND

Devices, such as accent top panels, that may be installed onto existing barrier panels, such as fence panels, railing panels, and gates, are known. Installing such devices onto existing barrier panels may serve variety of purposes, the most obvious being that it extends the height of the existing barrier panel so modified. This can, in turn, provide an added level of security, privacy, or both. In certain circumstances, the installation of such devices onto existing barrier panels may be needed to comply with various building code requirements as to barrier height. Besides these structural advantages, installation of such devices onto existing barrier panels may also be advantageous in terms of enhancing the visual appeal of otherwise plain barrier panels through the addition of new architectural/ornamental structures, designs, or motifs or in terms of matching the architectural/ornamental structures, designs, or motifs of the existing panels.

However, these known devices for extending the height of a barrier, such as accent top panels, also possess a number of significant disadvantages. One is that they are only configured for installation onto existing barrier panels that have square tube-shaped top railings. Another is that the only configuration for the top rail of these known devices is also in the form square-shaped tubing.

Accordingly, there remains a continuing need for devices capable of extending the height of existing barrier panels that possess improved versatility in terms of their configuration for installation onto such barrier panels, as well as the configuration of their top rail.

SUMMARY

Such improved versatility is possessed by the devices for extending the height of a barrier according to embodiments of the present invention. These and other advantages will be apparent from the present application of the embodiments described herein.

Embodiments of the present invention are directed to a device for extending the height of a barrier. The device comprises (1) an elongate member comprising a top surface and a downward-facing rail channel configured for downward installation onto a first top rail of a base barrier panel, wherein said rail channel is defined by a solid member having longitudinal edges and a pair of opposed side walls extending downwardly from said longitudinal edges, said pair of opposed side walls having inner surfaces facing said rail channel; wherein said inner surfaces comprise a plurality of pairs of opposed projections extending longitudinally along the inner surfaces and protruding inwardly into the rail channel; wherein a first pair of said opposed projections is situated at a position proximal to said solid member and configured to rest on an upward facing surface of a first top rail of a base barrier panel when said device is downwardly installed thereon; and wherein at least one further pair of said opposed projections is situated at a position distal to said solid member and configured to contact opposing sides of a first top rail of a base barrier panel when said device is downwardly installed thereon; (2) a decorative accent feature mounted on the top surface of the solid member and extending upwardly therefrom; and (3) a second top rail mounted to a top surface of the decorative accent feature.

In certain embodiments of the present invention, both the solid member and the pair of opposed side walls are planar. In certain other embodiments of the present invention, the pair of opposed side walls are perpendicular to the solid member.

In certain embodiments of the present invention, the first pair of said opposed projections are planar and perpendicular to said inner surfaces. In certain other embodiments of the present invention, said inner surfaces comprise second and third pairs of said opposed projections, wherein the second pair is situated at a first position distal to the solid member and the third pair is situated at a second position distal to the solid member, wherein said second position is further from the solid member than said first position. In certain other embodiments of the present invention, said second and third pairs of opposed projections protrude inwardly into the rail channel at an upward angle. In certain other embodiments of the present invention, said third pair of opposed projections comprises upwardly flanged longitudinal edges distal from said inner surfaces. In certain other embodiments of the present invention, said upwardly flanged longitudinal edges are parallel to said inner surfaces.

In certain embodiments of the present invention, the decorative accent feature comprises one or more balusters. In certain other embodiments of the present invention, the decorative accent feature comprises two balusters. In certain other embodiments of the present invention, the decorative accent feature comprises three balusters. In certain other embodiments of the present invention, the one or more balusters comprises a square-shaped horizontal cross-section.

In certain embodiments of the present invention, the second top rail is configured to accept installation of a handrail cap. In certain other embodiments of the present invention, the configuration of the second top rail is identical that of the first top rail of the base barrier panel.

Embodiments of the present invention are directed to systems for extending the height of a barrier comprising: (1) a device in accordance with embodiments of the present invention; (2) a plurality of end covers, wherein each end cover is configured to cover at least a portion of an end of an elongate member when installed thereon while still allowing for downward installation of said device onto a first top rail of a base barrier panel; and (3) a plurality of brackets, wherein each bracket is configured to secure the second top rail to a barrier post.

In certain embodiments of the present invention, the systems further comprise a plurality of fasteners configured to secure a bracket to both the second top rail and a barrier post.

Embodiments of the present invention are directed to methods of installing a system for extending the height of a barrier, the method comprising the steps of (1) providing a base barrier panel at least partially installed between two barrier posts, wherein the base barrier panel comprises a first top rail; (2) providing a system in accordance with embodiments of the present invention; (3) installing an end cover onto each end of the elongate member of said device; (4) downwardly installing the device from step (3) onto said first top rail such that the first pair of opposed projections rests on an upward facing surface of said first top rail and the at least one further pair of opposed projections contacts an opposing side of said first top rail; and (5) securing each end of the second top rail to a barrier post via a bracket.

In certain embodiments of the present invention, the methods further comprises the steps of (2.1) using a paper or plastic template to mark desired locations on each of the two barrier posts for installation of a bracket to which each end of the top rail of the device will be secured thereto, (2.2) predrilling the desired marked locations on each barrier post, (2.3) removing the template from the barrier posts, (2.4) aligning each bracket with the predrilled homes on each post, and (2.5) fastening each bracket to each post using fasteners.

In certain embodiments of the present invention, the methods further comprise the steps of (2.1a) positioning the device of said system between said two barrier posts, (2.2b) adjusting the position of the device to achieve a desired spacing for said decorative accent feature, (2.3c) applying a mark to each end of said elongate member and each end of said second top rail at a point where they intersect with an inner edge of a barrier post, (2.4d) measuring from each mark toward the center of the device a distance sufficient to allow for bracket clearance to obtain a cut location, and (2.5e) cutting each end of said elongate member and each end of said second top rail at said cut location, prior to step (3).

In certain embodiments of the present invention, the methods further comprise the step installing end covers onto each end of a handrail cap, followed by installing the handrail cap onto the top rail of the device, prior to step (5).

The preceding is a simplified summary to provide an understanding of some embodiments of the present invention. This summary is neither an extensive nor exhaustive overview of the present invention and its various embodiments. The summary presents selected concepts of the embodiments of the present invention in a simplified form as an introduction to the more detailed description presented below. As will be appreciated, other embodiments of the present invention are possible utilizing, alone or in combination, one or more of the features set forth above or described in detail below.

BRIEF DESCRIPTION OF THE DRAWINGS

The foregoing and other aspects of the embodiments disclosed herein are best understood from the following detailed description when read in connection with the accompanying drawings. For the purpose of illustrating the embodiments disclosed herein, there is shown in the drawings embodiments that are presently preferred, it being understood, however, that the embodiments disclosed herein are not limited to the specific instrumentalities disclosed. Included in the drawings are the following figures.

DETAILED DESCRIPTION

Figure 1A:
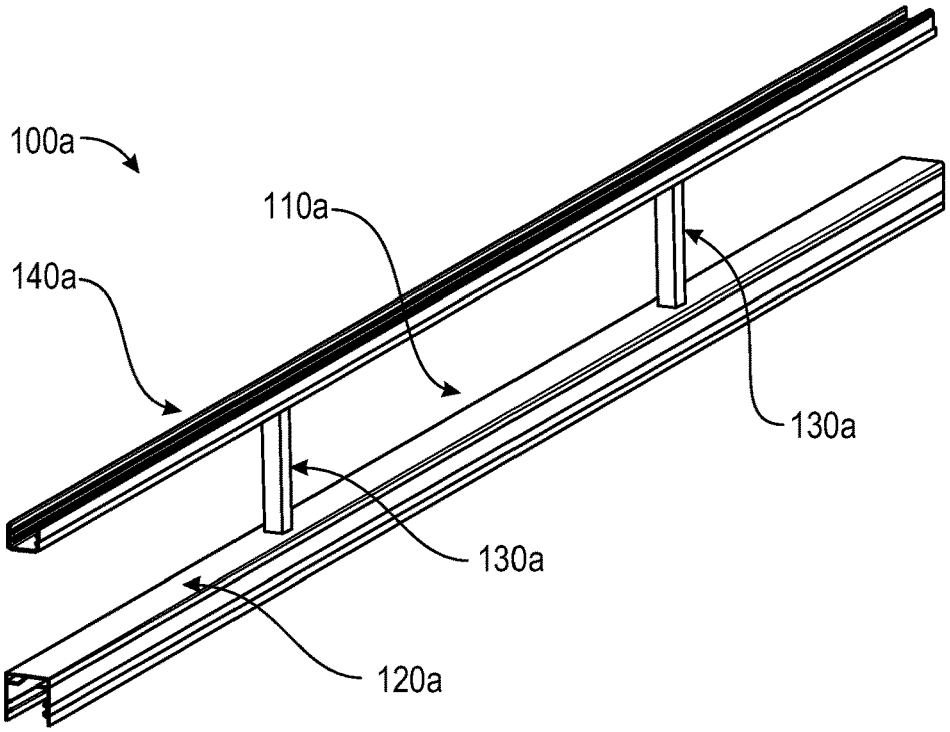
FIG. 1A illustrates a perspective view of device for extending the height of a barrier according to embodiments of the present invention disclosed herein.

While embodiments of the present invention are described herein by way of example using several illustrative drawings, those skilled in the art will recognize the present invention is not limited to the embodiments or drawings described. It should be understood the drawings and the detailed description thereto are not intended to limit the present invention to the particular form disclosed, but to the contrary, the present invention is to cover all modification, equivalents and alternatives falling within the spirit and scope of embodiments of the present invention as defined by the appended claims.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including, but not limited to. To facilitate understanding, like reference numerals have been used, where possible, to designate like elements common to the figures.

The phrases "at least one", one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C"

and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

An aspect of the present invention are devices for extending the height of a barrier. In accordance with embodiments of the present invention, these devices comprise an elongate member comprising a top surface, a decorative accent feature mounted on the top surface of the elongate member and extending upwardly therefrom, and a top rail mounted to a top surface of the decorative accent feature. In accordance with embodiments of the present invention, the elongate member comprises a downward-facing rail channel configured to allow downward installation of devices according to embodiments of the present invention onto a top rail of a base barrier panel. Examples of such base barrier panels include, but are not limited to, fence panels, railing panels, gates, and the like. The rail channel is defined by a solid member having longitudinal edges and a pair of opposed side walls extending downwardly from the longitudinal edges of solid member. Each of the opposed side walls have inner surfaces facing the rail channel.

The inner surfaces of the opposed side walls comprise a plurality of pairs of opposed projections extending longitudinally along the inner surfaces and protruding inwardly into the rail channel. A first pair of opposed projections is situated along the inner surfaces at a position proximal to the solid member and is configured to rest on an upward facing surface of a top rail of a base barrier panel when devices in accordance with the present invention are downwardly installed thereon. At least one further pair of opposed projections is situated along the inner surfaces at positions distal to the solid member and are configured to contact opposing sides of a top rail of a base barrier panel when devices in accordance with embodiments of the present invention are downwardly installed thereon. In certain embodiments, the inner surfaces comprise second and third pairs of opposed projections, wherein the second pair is situated at a first position distal to the solid member and the third pair is situated at a second position distal to the solid member, wherein the second position is further from the solid member than the first position.

The devices in accordance with embodiments of the present invention may be fabricated from and/or comprise any desired material. Examples of such materials include, but are not limited to, metals such as aluminum, steel, copper, magnesium, zinc, and any combinations and alloys thereof. In certain embodiments, the devices in accordance with embodiments of the present invention are fabricated from and/or comprise aluminum.

Figure 1B:
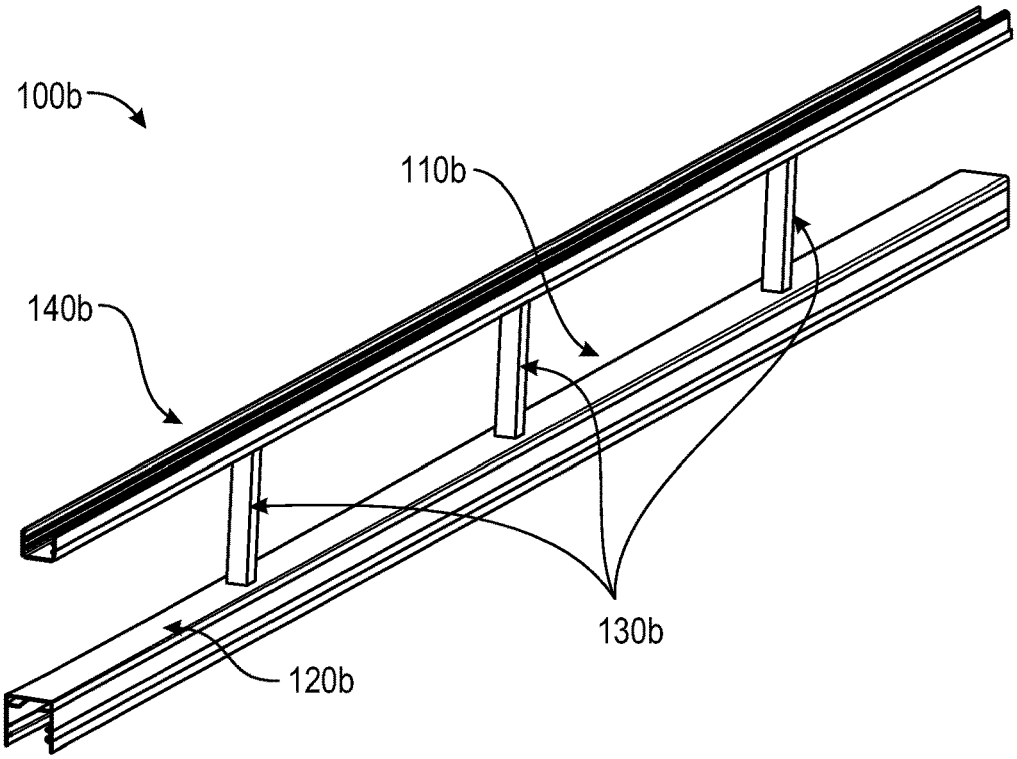
FIG. 1B illustrates a perspective view of device for extending the height of a barrier according to embodiments of the present invention disclosed herein.
Figure 2:
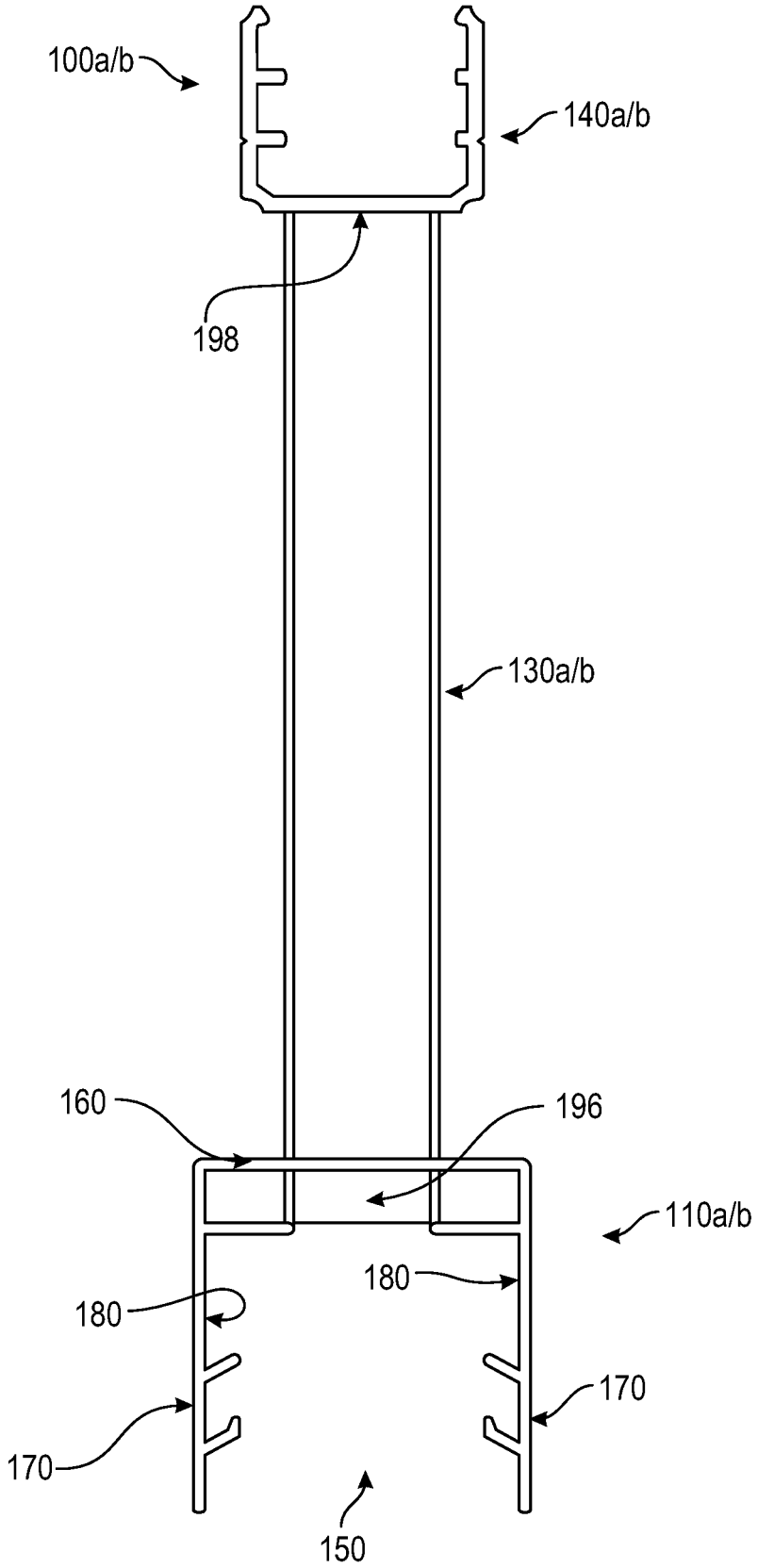
FIG. 2 illustrates a transverse cross sectional view of devices for extending the height of a barrier according to embodiments of the present invention disclosed herein.

FIGS. 1A and 1B illustrate perspective views of devices 100*a* and 100*b* for extending the height of a barrier according to embodiments of the present invention. Devices 100*a* and 100*b* each respectively comprise an elongate member (110*a*, 110*b*) comprising a top surface (120*a*, 120*b*), a decorative accent feature (130*a*, 130*b*) mounted on top surface (120*a*, 120*b*) of elongate member (110*a*, 110*b*) and extending upwardly therefrom, and a top rail (140*a*, 140*b*) mounted to a top surface of decorative accent feature (130*a*, 130*b*). FIG. 2 illustrates a transverse cross sectional view of a devices 100*a* and 100*b* for extending the height of a barrier according to embodiments of the present invention. Elongate member 110*a/b* comprises a downward-facing rail channel 150 configured to allow downward installation of devices according to embodiments of the present invention onto a top rail of a base barrier panel. Rail channel 150 is defined by a solid member 160 having longitudinal edges and a pair of opposed side walls 170 extending downwardly from the longitudinal edges of solid member 160. Each of the opposed side walls 170 have inner surfaces 180 facing rail channel 150. In certain embodiments, the distance between opposed side walls 170 is 1.65".

Figure 3A:
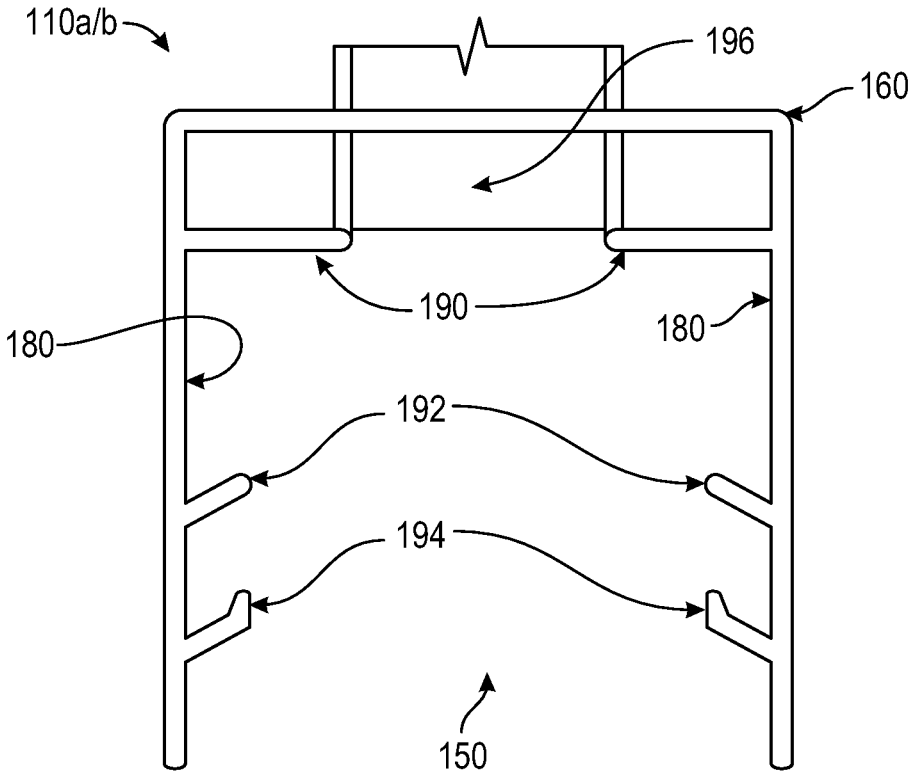
FIG. 3A illustrates a transverse cross sectional view of elongate member of devices for extending the height of a barrier according to embodiments of the present invention disclosed herein.
Figure 3B:
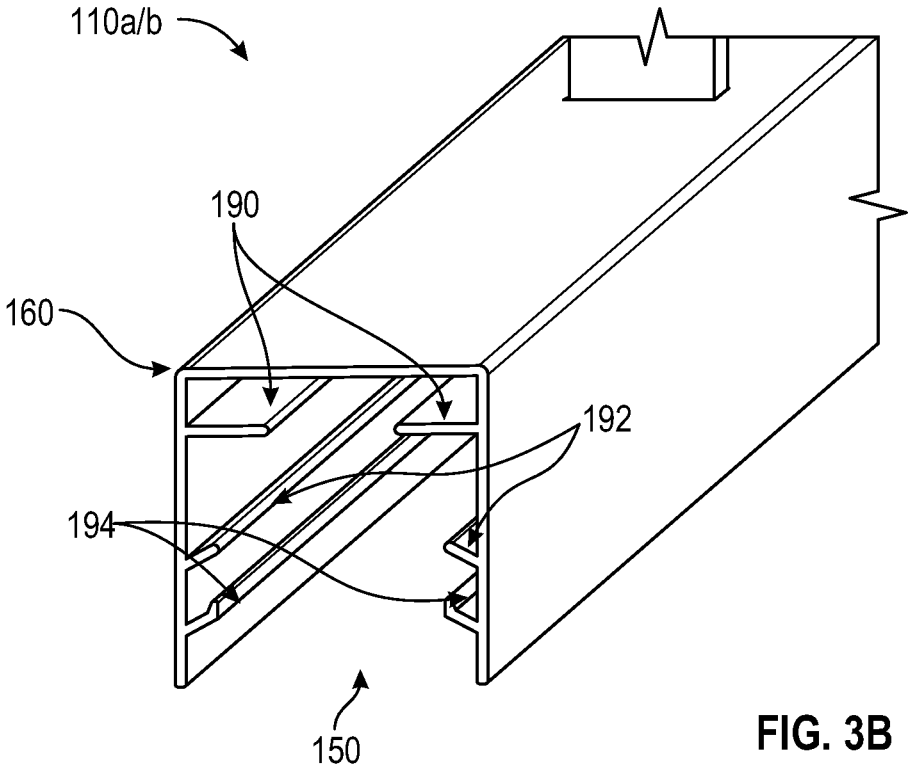
FIG. 3B illustrate a perspective view of elongate member of devices for extending the height of a barrier according to embodiments of the present invention disclosed herein.

FIGS. 3A and 3B illustrate transverse cross sectional and perspective views, respectively, of elongate member 110*a*/110*b* of devices 100*a* and 100*b* for extending the height of a barrier according to embodiments of the present invention. Referring to FIGS. 3A and 3B, inner surfaces 180 comprise a plurality of pairs of opposed projections 190, 192, and 194 extending longitudinally along inner surfaces 180 and protruding inwardly into rail channel 150. A first pair of opposed projections 190 is situated along inner surfaces 180 at a position proximal to solid member 160. First pair of opposed projections 190 is configured to rest on an upward facing surface of a top rail of a base barrier panel when devices 100*a* and 100*b* are downwardly installed thereon. Second and third pairs of opposed projections 192 and 194 are situated along inner surfaces 180 at positions distal to solid member 160, third pair of opposed projections 194 being positioned further from solid member 160 than second pair of opposed projections 192. Opposed projections 192 and 194 are configured to contact opposing sides of a top rail of a base barrier panel when devices 100*a* and 100*b* are downwardly installed thereon.

In accordance with embodiments of the present invention, each of the first pair of opposed projections, independently, may have any desired configurations, orientations, widths, and positions proximal to the solid member that enables them to rest on an upward facing surface of a top rail of a base barrier panel when a device according to embodiments of the present invention is downwardly installed thereon. Examples of such upward facing surfaces include, but are not limited to, flat surfaces, convex curved surfaces, concave curved surfaces, irregularly shaped surfaces, the upward facing edges of a pair of upwardly directed planes, and the like. In certain embodiments, the first pair of opposed projections may have a planar configuration. In certain other embodiments, the first pair of opposed projections may have an orientation perpendicular to the inner surfaces from which they protrude. In yet certain other embodiments, the first pair of opposed projections may be symmetrical in configuration, orientation, width, and position.

In accordance with embodiments of the present invention, each the at least one further pair of opposed projections, independently, may have any desired configurations, orientations, widths, and position(s) distal to the solid member that enables them to contact the surfaces of opposing sides of a top rail of a base barrier panel when a device according to embodiments of the present invention is downwardly installed thereon. Examples of such surfaces of opposing sides include, but are not limited to, flat surfaces, convex curved surfaces, concave curved surfaces, irregularly shaped surfaces, and the like. In certain embodiments, the at least one further pair of opposed projections may, independently, have a planar configuration. In certain other embodiments, the at least one further pair of opposed projections may, independently, have an orientation perpendicular to the inner surfaces from which they protrude. In certain other embodiments, the at least one further pair of opposed projections may, independently, have an orientation whereby they protrude inwardly into the rail channel at an upward angle relative to the inner surfaces from which they protrude. In certain embodiments, the at least one further pair of opposed projections may, independently, have a configuration whereby they comprise upwardly flanged longitudinal edges distal from the inner surfaces, wherein in certain other embodiments thereof such upwardly flanged longitudinal edges are parallel to the inner surfaces. Without being bound by theory, it may be expected that providing the at least one further pair of opposed projection with an upwardly angled orientation and/or an upwardly flanged configuration will facilitate the insertion of the top rail of a base barrier panel into the rail channel when a device according to embodiments of the present invention is downwardly installed thereon. It may also be expected, without being bound by theory, that providing the at least one further pair of opposed projections with an upwardly flanged configuration will facilitate surface area contact with the opposing sides of a top rail of a base barrier when a device according to embodiments of the present invention is downwardly installed thereon. In yet certain other embodiments, the at least one further pair of opposed projections may, independently, be symmetrical in configuration, orientation, width, and position.

Referring to FIGS. 3A and 3B, first pair of opposed projections 190 comprise a planar configuration and a perpendicular orientation to planar inner surfaces 180 and parallel to planar solid member 160. Second pair of opposed projections 192 comprise a planar configuration and an orientation such that they protrude inwardly into rail channel 150 at an upward angle. Third pair of opposed projections 194 comprise a partial planar configuration that comprises upwardly flanged longitudinal edges distal from and substantially parallel to inner surface 180 and an orientation such that they protrude inwardly into rail channel 150 at an upward angle.

Figure 4:
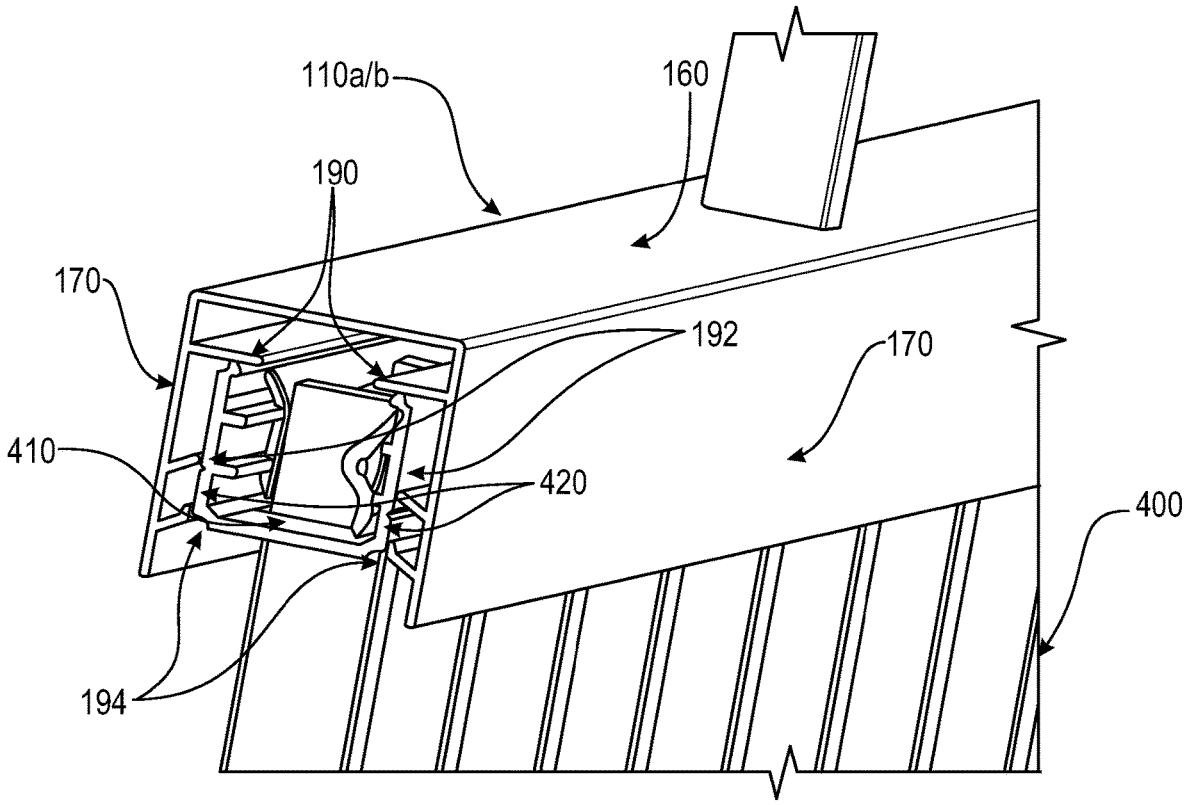
FIG. 4 illustrates a perspective view of elongate member of devices for extending the height of a barrier according to embodiments of the present invention disclosed herein after downward installation onto a top rail of an exemplary base barrier panel.

FIG. 4 illustrates a perspective view of elongate member 110*a*/110*b* of device 100*a* or 100*b* for extending the height of a barrier according to embodiments of the present invention after downward installation of device 100*a* or 100*b* onto a top rail 410 of an exemplary base barrier panel 400. Referring to FIG. 4, each of first pair of opposed projections 190 are configured to rest on a separate upward facing edge of a pair of upwardly directed opposed side walls 420 of top rail 410 of base barrier panel 400. Second and third pairs of opposed projections 192 and 194 are configured to contact the outer surfaces of opposed side walls 420 of top rail 410 of base barrier panel 400.

In accordance with embodiments of the present invention, the solid member and each of the opposed side walls may, identically or differently, have any desired dimensions, shape, and/or geometry, e.g., planar, curved, etc. Referring to FIG. 2, both solid member 160 and opposed side walls 170 of elongate member 110*a*/110*b* of devices 100*a* and 100*b* are planar in shape and/or geometry. In accordance with embodiments of the present invention, each of the opposed side walls may also be oriented relative to the solid member and each other in any desired manner, e.g., perpendicular, parallel, etc. Referring to FIG. 2, both opposed side walls 170 of elongate member 110*a*/110*b* of devices 100*a* and 100*b* are oriented parallel to each other and each are oriented perpendicular to solid member 160. In accordance with embodiments of the present invention, the opposed side walls may, independently, extending downwardly from the longitudinal edges of the solid member by any desired length. In certain embodiments, the opposed side walls may, independently, extend downwardly from the longitudinal edges of the solid member such that they extend past a bottom surface of a top rail of a base barrier panel when a device according to embodiments of the present invention is downwardly installed thereon. In certain other embodiments, the opposed side walls may, independently, extend downwardly from the longitudinal edges of the solid member such that they are flush with a bottom surface of a top rail of a base barrier panel when a device according to embodiments of the present invention is downwardly installed thereon. In yet certain other embodiments, the opposed side walls may, independently, extend downwardly from the longitudinal edges of the solid member such that they do not extend past a bottom surface of a top rail of a base barrier panel when a device according to embodiments of the present invention is downwardly installed thereon. In certain embodiments, when the opposed side walls extend downwardly from the longitudinal edges of the solid member such that they are flush with or extend past a bottom surface of a top rail of a base barrier panel when a device according to embodiments of the present invention is downwardly installed thereon, the resulting aesthetic feature may desirably create an illusion that the device and the base barrier panel are a single panel. Referring to FIG. 4, both opposed side walls 170 of elongate member 110*a*/110*b* extend downwardly from the longitudinal edges of solid member 160 such that they extend past the bottom surface of top rail 410 of base barrier panel 400 when device 100*a* or 100*b* according to embodiments of the present invention is downwardly installed thereon.

The decorative accent feature of the devices according to embodiments of the present invention may comprise any desired architectural and/or ornamental structure, dimensions, shape, design, style, and/or motif. Examples of such architectural and/or ornamental structures, shapes, designs, styles, and/or motifs that may be used as decorative accent features in embodiments of the present invention include, but are not limited to, balusters, geometric shapes (e.g., circles), scrolls, pickets, and any combination thereof. In certain embodiments, the decorative accent feature according to embodiments of the present invention may comprise one or more upright members each independently having an architectural and/or ornamental structure, shape, design, style, and/or motif extending upwardly from the top surface of the elongate member to a bottom surface of a top rail. In certain embodiments, the decorative accent feature may be configured, oriented, and/or positioned relative to the architectural and/or ornamental structure, dimensions, shape, design, style, and/or motif of the base barrier panel on which the devices according to the present invention are downwardly installed so as to result in an illusion that the device and the base barrier panel are a single panel. In certain embodiments, the decorative accent feature according to embodiments of the present invention may comprise one or more balusters. Such balusters may themselves comprise any desired structure, shape, design, style, and/or motif. In certain embodiments according to the present invention, the one or more such balusters may comprise a square-shaped horizontal cross-section. Referring to FIG. 1A, the decorative accent feature of device 100*a* according to embodiments of the present invention comprises two balusters 130*a*. Referring to FIG. 1B, the decorative accent feature of devices 100*b* according to embodiments of the present invention comprises two three balusters 130*b*.

Figure 5:
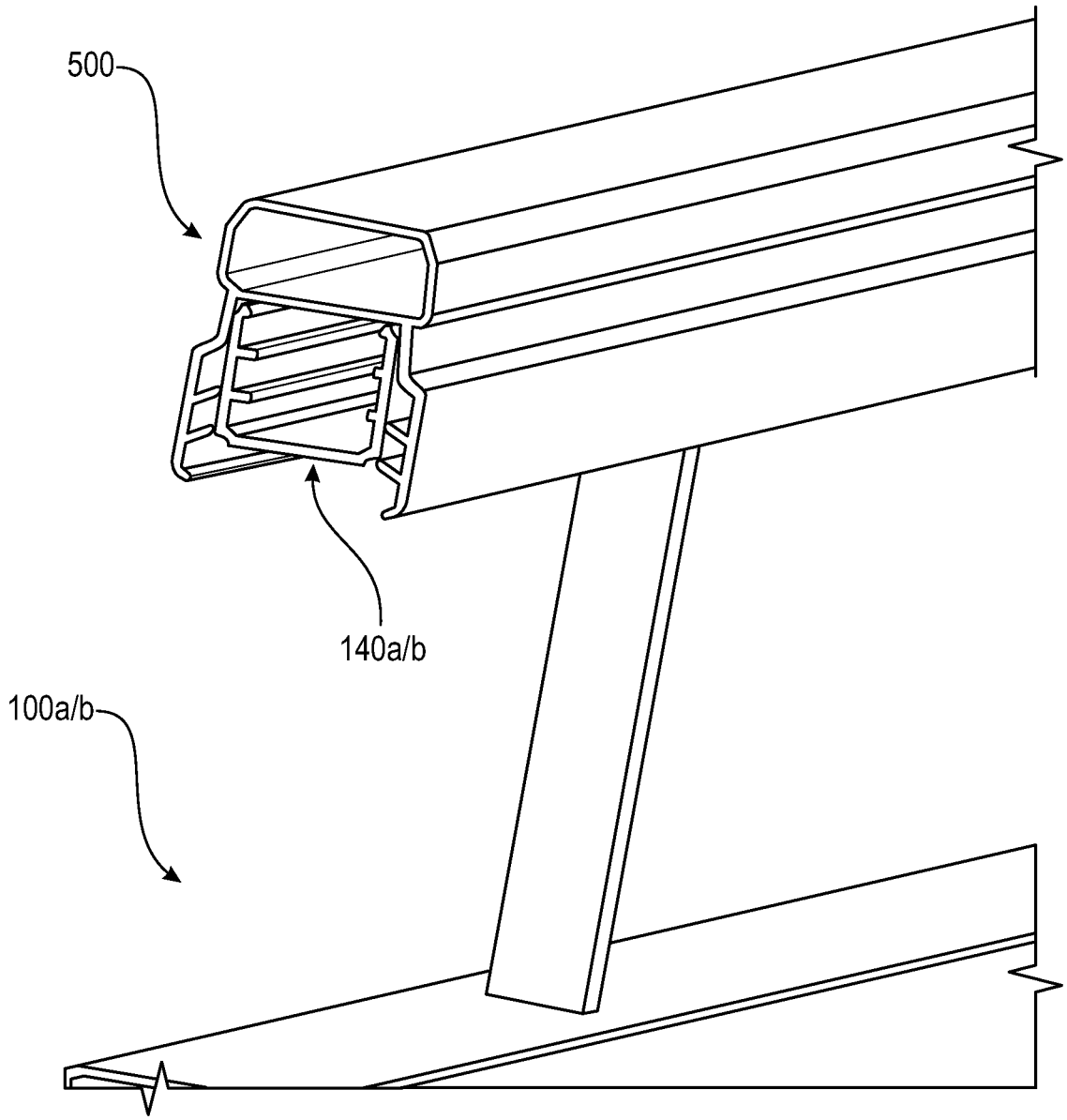
FIG. 5 illustrates a perspective view of devices for extending the height of a barrier according to embodiments of the present invention disclosed herein wherein a handrail cap has been installed thereon.

The top rail of the devices according to embodiments of the present invention may comprise any desired functional, architectural, and/or ornamental structure, dimensions, shape, design, style, and/or motif. In certain embodiments, the top rail may be configured as a handrail. In certain other embodiments, the top rail may configured to accept installation of a handrail cap. FIG. 5 illustrates a perspective view of devices 100*a* or 100*b* for extending the height of a barrier according to embodiments of the present invention wherein a handrail cap has been installed thereon. Referring to FIG. 5, handrail cap 500 is installed on top rail 140*a/b*, which is configured to accept installation of a handrail cap, of devices 100*a* or 100*b*. In certain embodiments where the top rail configured to accept installation of a handrail cap, this configuration may be identical to that of a top rail of a base barrier panel onto which the devices according to embodiments of the present invention may be downwardly installed. In such embodiments, the devices according to embodiments of the present invention may desirably and advantageously be a part or an element of a modular and/or customizable barrier system, e.g., both the top rail of devices according to embodiments of the present invention and the top rail of the base barrier panel are identically configured to accept installation of various styles of handrail cap. Referring to FIGS. 2 and 4, top rail 140*a/b* is substantially identical in configuration to top rail 410 of base barrier panel 400, which are both configured to accept installation of a handrail cap.

In accordance with the various embodiments of the present invention, each of the decorative accent feature and top rail may identically or differently be mounted on the top surface of the elongate member and a top surface of the decorative accent feature, respectively, by any desired means. In certain embodiments according to the present invention, each of the decorative accent feature and top rail may identically or differently be mounted directly onto the top surface of the elongate member and a top surface of the decorative accent feature, respectively. In certain other embodiments according to the present invention, each of the decorative accent feature and top rail may identically or differently be mounted on the top surface of the elongate member and a top surface of the decorative accent feature, respectively, via insertion of one or more bottom and/or top portions of the decorative accent feature into one or more apertures located on the top surface of the elongate member and/or a bottom surface of the top rail. In certain embodiments according to the present invention, each of the decorative accent feature and top rail identically or differently mounted on the top surface of the elongate member and a top surface of the decorative accent feature, respectively, may be securely attached using any desired means. Examples of such means include welding, gluing, e.g., with an adhesive, fasteners, e.g. screws, and the like. Referring now to FIGS. 2 and 3A, decorative accent feature 130*a/b* is mounted on top surface 120*a/b* of elongate member 110*a/b* via insertion of bottom portion 196 of decorative accent feature 130*a/b* into an aperture located on top surface 120*a/b* of elongate member 110*a/b*, wherein bottom portion 196 of decorative accent feature 130*a/b* rests on each of first pair of opposed projections 190. Referring now to FIG. 2, top rail 140*a/b* is directly mounted onto a top surface of decorative accent feature 130*a*/130*b*.

Another aspect of the present invention are systems for extending the height of a barrier. In accordance with embodiments of the present invention, these systems comprise a device for extending the height of a barrier as described herein, a plurality of end covers, and a plurality of brackets. In certain embodiments, the systems in accordance with the present invention comprise at least two end covers. In certain embodiments, the systems in accordance with the present invention comprise at least two brackets. In accordance with embodiments of the present invention, these systems may further comprises a plurality of fasteners configured to secure a bracket to both the second top rail and a barrier post. Examples of such fasteners may include, but are not limited to, screws, nails, bolts, anchors, rivets, and the like. In certain embodiments, the systems according to embodiments of the present invention may comprise a plurality, e.g., at least 12, of screws, e.g., 1½" screws.

Figure 6A:
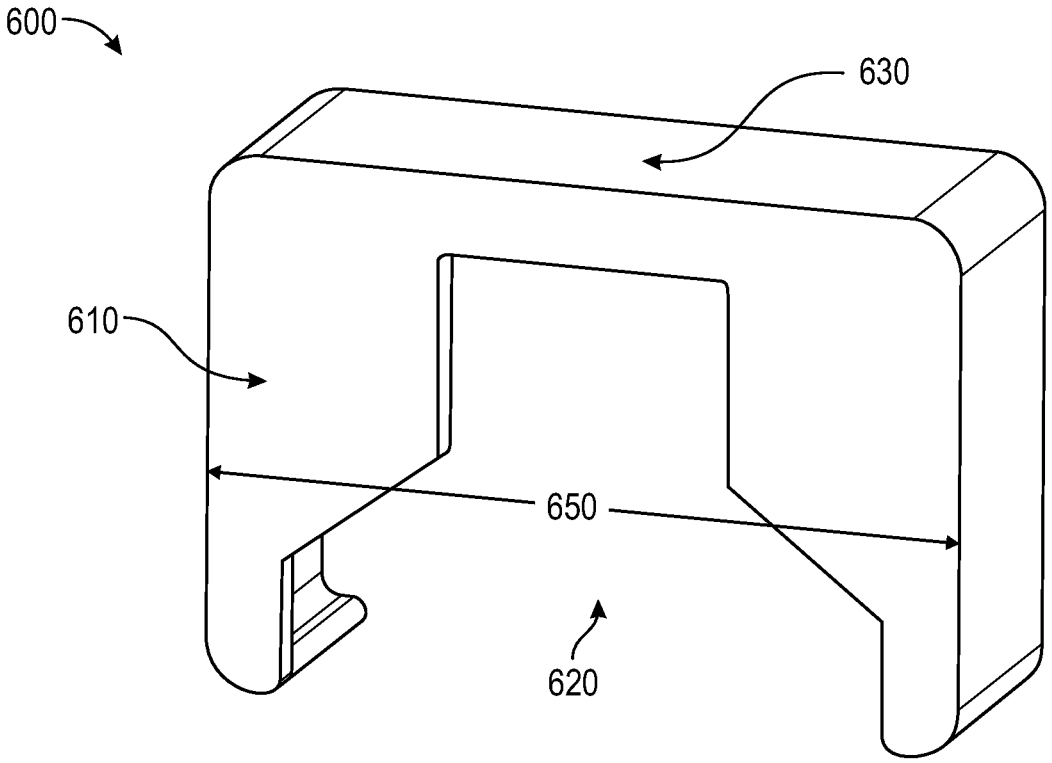
FIG. 6A illustrates a front perspective view of an end cover configured for installation on an end of elongate member of devices in accordance with embodiments of the present invention disclosed herein.
Figure 6B:
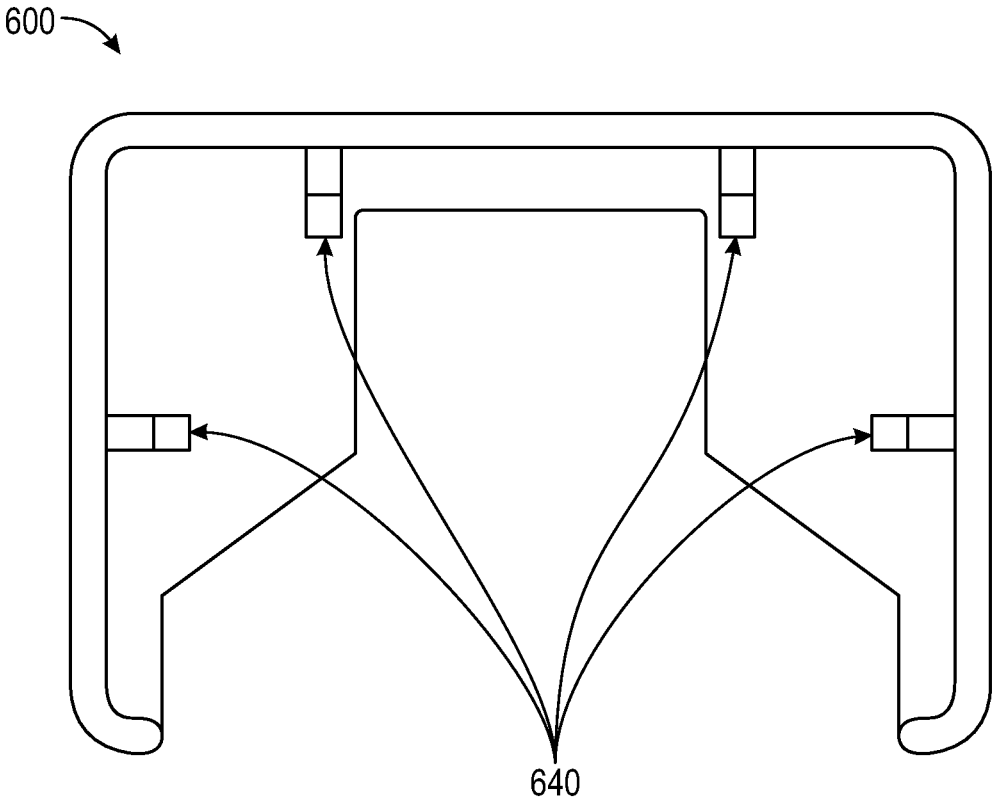
FIG. 6B illustrates a rear view of an end cover configured for installation on an end of elongate member of devices in accordance with embodiments of the present invention disclosed herein.

Each end cover of the systems in accordance with embodiments of the present invention is configured to cover at least a portion of an end of the elongate member of the device when installed thereon, while still allowing for downward installation of the device onto a top rail of a base barrier panel. FIGS. 6A and 6B illustrate front perspective and rear views, respectively, of an end cover 600 configured for installation on an end of elongate member 110*a/b* of device 100*a* or 100*b* in accordance with embodiments of the present invention. Referring now to FIGS. 6A and 6B, end cover 600 is configured to cover at least a portion of the end of elongate member 110*a/b* when installed thereon, while still allowing for downward installation of device 100*a* and 100*b* onto a top rail of a base barrier panel. End cover 600 comprises a face 610 configured to completely cover the exposed edges of an end of elongate member 110*a/b* and at least partially cover opposed projections 190, 192, and 194 and bottom portion 196 of decorative accent feature 130*a/b*, while leaving a gap 620 so as to avoid obstruction of downward installation of device 100*a* and 100*b* onto a top rail of a base barrier panel. End cover 600 further comprises a side wall 620 and a plurality of protrusions 640 configured to contact the outer and inner surfaces, respectively, of an end of elongate member 110*a/b* when installed thereon such that end cover 600 is securely held in place in a press-fit manner. In certain embodiments, the width 650 from one lateral edge of end cover 600 to the other may be 1.84".

Figure 7:
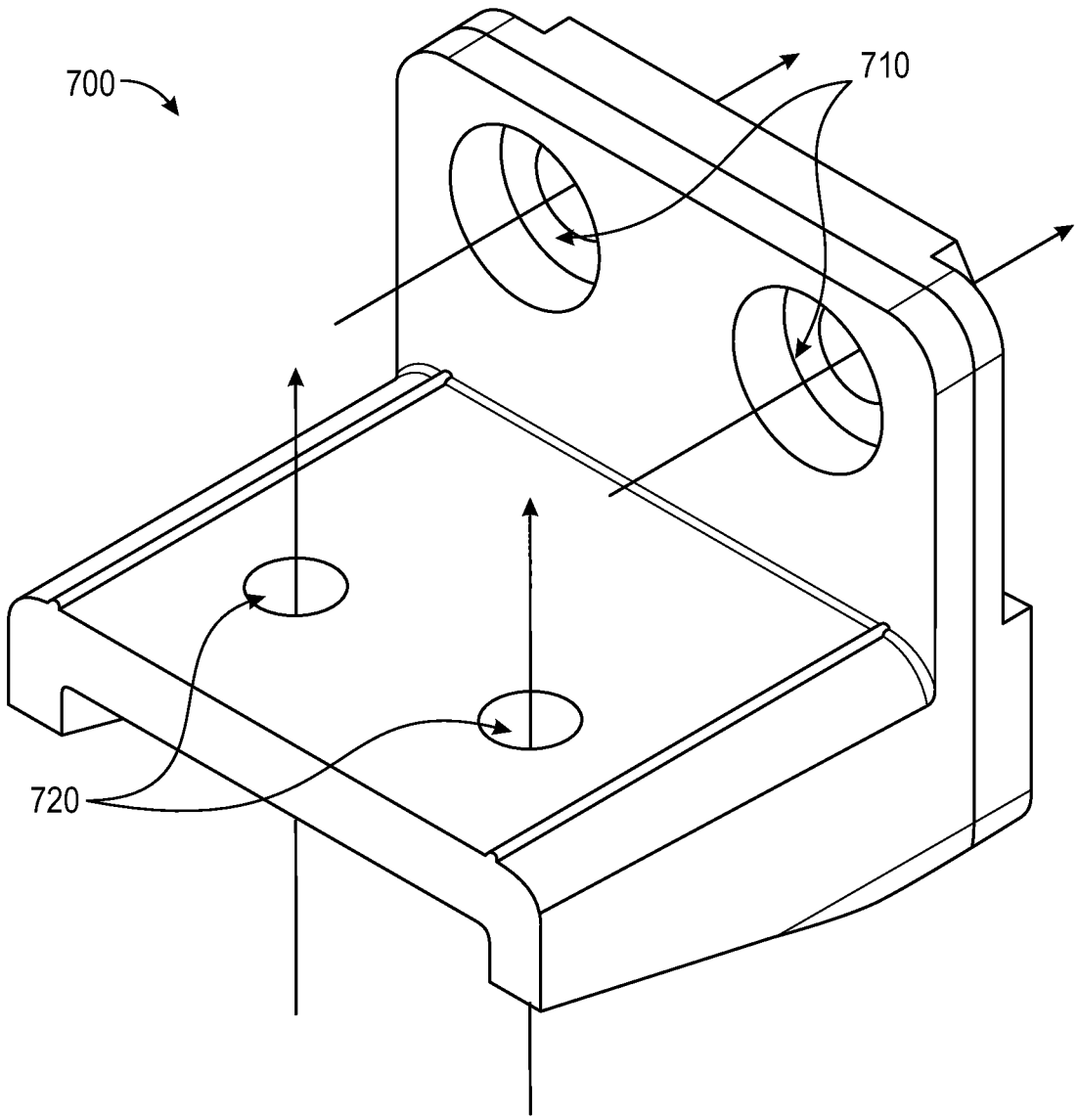
FIG. 7 illustrates a front perspective view of a bracket configured to secure an end of top rail of devices in accordance with embodiments of the present invention as disclosed herein which has been downwardly installed onto a barrier post supporting a base barrier panel.

Each bracket of the systems in accordance with embodiments of the present invention is configured to secure an end of the top rail of the device to a barrier post supporting a base barrier panel onto which the device has been downwardly installed. FIG. 7 illustrates a front perspective view of a bracket 700 configured to secure an end of top rail 140*a/b* of device 100*a* or 100*b* to a barrier post supporting a base barrier panel onto which device 100*a* or 100*b* has been downwardly installed in accordance with embodiments of the present invention. Bracket 700 comprises two holes 710 through which bracket 700 is anchored to the surface of a barrier post using a pair of fasteners, e.g., screws. Bracket 700 further comprises two holes 720 through which the bottom surface of top rail 140*a/b* is anchored to bracket 700 using a pair of fasteners, e.g., screws.

Another aspect of the present invention are methods of installing a system for extending the height of a barrier. In accordance with embodiments of the present invention, these methods comprise the steps of (1) providing a base barrier panel at least partially installed between two barrier posts, the base barrier panel comprising a top rail, (2) providing a system for extending the height of a barrier as described herein, (3) installing an end cover onto each end of the elongate member of the device comprised in the system, (4) downwardly installing the device having end covers installed thereon onto the top rail of the base barrier panel such that the first pair of opposed projections rests on an upward facing surface of the top rail and at least one further pair of opposed projections contacts the opposing sides of the top rail, and (5) securing each end of the top rail of the device to a barrier post via a bracket. In accordance with embodiments of the present invention, these methods may comprise additional steps. These additional steps may be performed prior to step (1), after step (5), and/or intermediate to any of steps (1) through (5). In certain embodiments, intermediate to steps (2) and (3), the methods of the present invention further comprise the steps of: using a paper or plastic template to mark desired locations on each of the two barrier posts for installation of a bracket to which each end of the top rail of the device will be secured thereto, predrilling the desired marked locations on each barrier post, removing the template from the barrier posts, aligning each bracket with the predrilled homes on each post, and fastening each bracket to each post using fasteners. In certain embodiments, the predrilled holes are drilled using a ⅛" drill bit and the brackets are fastened using 1½" screws. In accordance with embodiments of the present invention, the length of the device may be shortened to obtain a custom fit prior to installation onto a base barrier panel. In certain embodiments, intermediate to steps (2) and (3), the methods of the present invention further comprise the steps of: positioning the device between the two barrier posts, adjusting the position of the device to achieve a desired spacing for the decorative accent feature, applying a mark to each end of the elongate member and each end of the top rail of the device at a point where they each intersect with the inner edge of a barrier post, measuring from each mark toward the center of the device a distance sufficient to allow for bracket clearance to obtain a cut location, and cutting each end of the elongate member and each end of the second top rail at each cut location. In certain embodiments, the distance sufficient to allow for bracket clearance is ¼". In certain embodiments, prior to step (5), installation of the base barrier is completed after downward installation of the device thereon via the steps of: predrilling holes through the bottom surface of the top rail of the base barrier panel using the holes of a previously installed bracket as a guide, and installing fasteners through the holes in the bracket and into the predrilled holes of the top rail of the base barrier panel. In certain embodiments, the fasteners used to complete installation of the base barrier are 1½" screws. In certain embodiments, intermediate to steps (3) and (5), the methods of the present invention further comprise the steps of: installing end covers onto each end of a handrail cap, followed by installing the handrail cap onto the top rail of the device. In certain embodiments, the handrail cap is measured and cut to have the same length as the top rail prior to installation thereon. In certain embodiments, prior to step (5), each end of the top rail of the device is secured to a barrier post via a bracket via the steps of: predrilling holes through the bottom surface of the top rail of the device and, if applicable, the bottom surface of an installed handrail cap, using the holes in the bracket as a guide, and installing fasteners through the holes in the bracket and into the predrilled holes of the top rail and, if applicable, the handrail cap. In certain embodiments, the fasteners used to secure the top rail of the device and, if applicable, an installed handrail cap, are 1⅝" screws.

Figure 8:
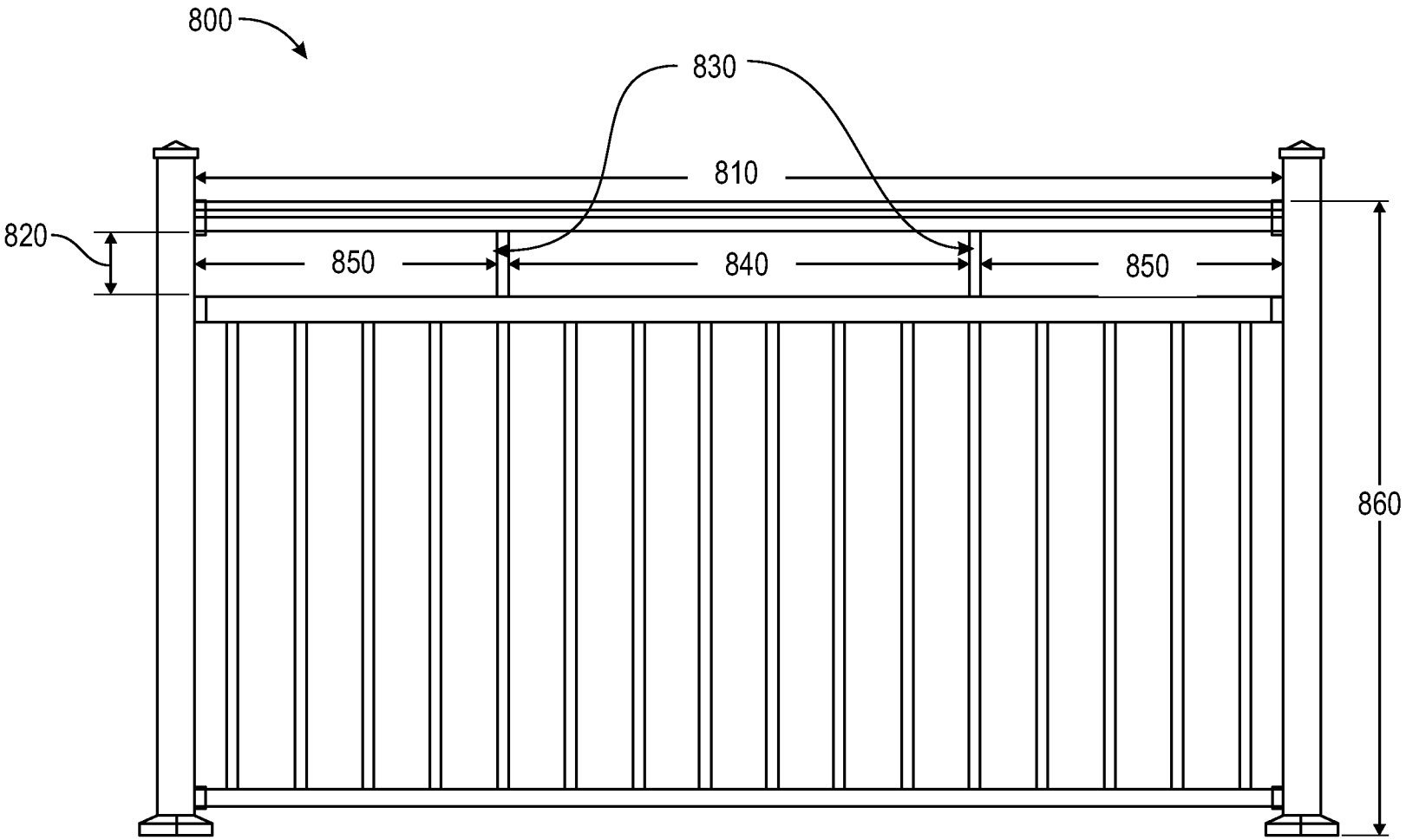
FIG. 8 and illustrate a device in accordance with embodiments of the present invention as disclosed herein having been downwardly installed onto a base barrier panel and secured to barrier posts supporting the base barrier panel.
Figure 9:
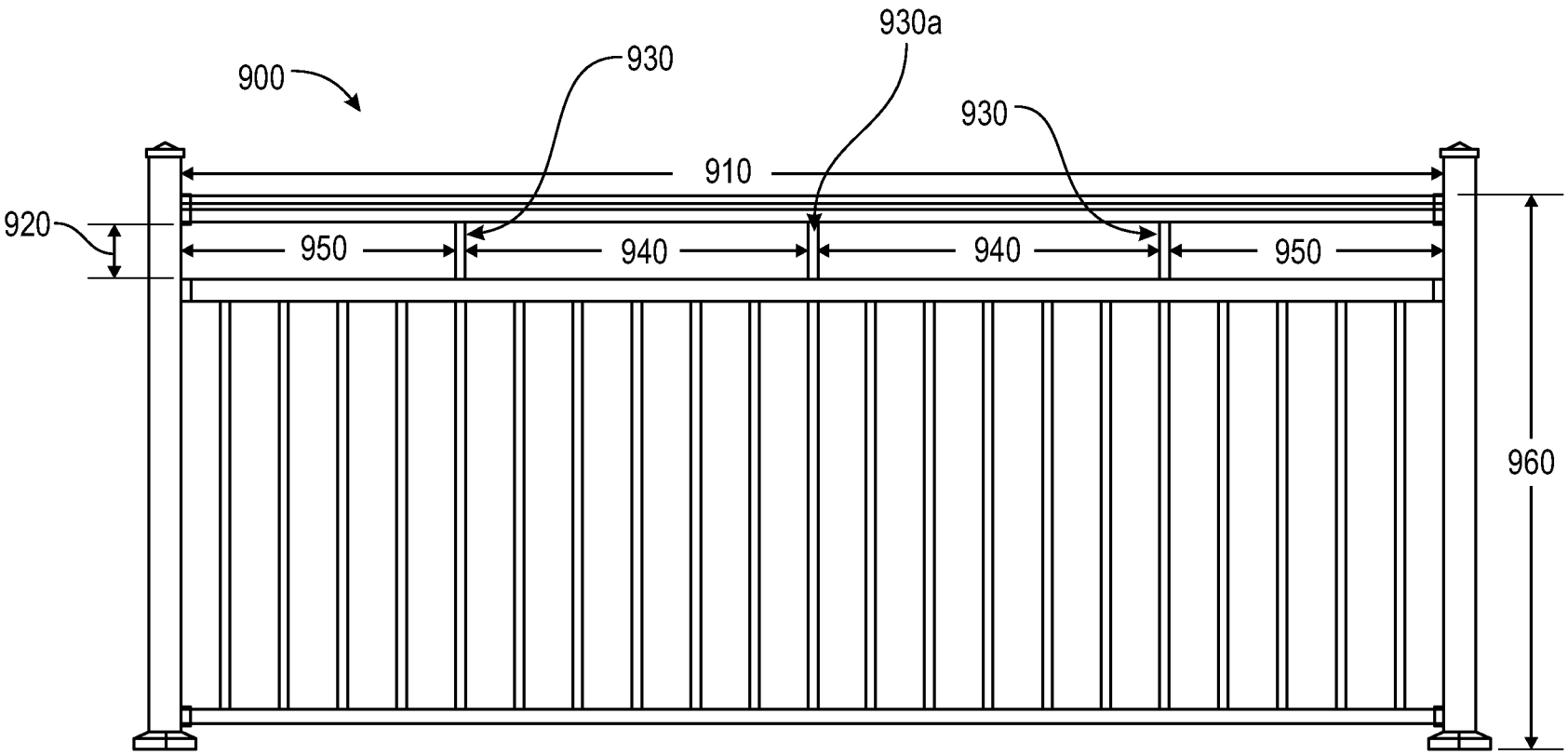
FIG. 9 and illustrate a device in accordance with embodiments of the present invention as disclosed herein having been downwardly installed onto a base barrier panel and secured to barrier posts supporting the base barrier panel.

FIGS. 8 and 9 illustrate devices 800 and 800, respectively, having been downwardly installed onto base barrier panels and secured to barrier posts supporting the base barrier panels in accordance with embodiments of the present invention.

Referring to FIG. 8, device 800 has been finished with the installation thereon of a handrail cap and end caps on each end of the elongate member and top rail with handrail cap. The overall length 810 of device 800 may be 72.00", which may include a combined 0.50" accounting for the thickness of each installed end cap (e.g., 0.25"). In certain embodiments, the maximum installed length of device 800 of no more than 72.00". The distance 820 between the top surface of the elongate member and the bottom surface of the installed handrail cap may be 4.25". Device 800 comprises two balusters 830 having square horizontal cross sections. Each baluster 830 may have a width of 0.73". The distance 840 between balusters 830 may be 30.56" and the maximum distances 850 from each baluster 830 to its closest barrier post may be no more than 19.99". The height of device 800 from the surface may be 42.00". In certain embodiments, installation of devices in accordance with embodiments of the present invention onto base barrier panels increases the overall height of the base barrier panel by 6.00". In certain other embodiments, installation of devices in accordance with embodiments of the present invention onto a base barrier panels increases the overall height of the base barrier panel from 36.00" to 42.00".

Referring to FIG. 9, device 900 has been finished with the installation thereon of a handrail cap and end caps on each end of the elongate member and top rail with handrail cap. The overall length 910 of device 900 may be 96.00", which may include a combined 0.50" accounting for the thickness of each installed end cap (e.g., 0.25"). In certain embodiments, the maximum installed length of device 900 of no more than 96.00". The distance 920 between the top surface of the elongate member and the bottom surface of the installed handrail cap may be 4.25". Device 900 comprises three balusters 930/930*a* having square horizontal cross sections. Each baluster 930 may have a width of 0.73". The distance 940 between each balusters 930 and 930*a* may be 26.09" and the maximum distances 950 from balusters 930 to its closest barrier post may be no more than 20.81". The height of device 900 from the surface may be 42.00". In certain embodiments, installation of devices in accordance with embodiments of the present invention onto base barrier panels increases the overall height of the base barrier panel by 6.00". In certain other embodiments, installation of devices in accordance with embodiments of the present invention onto a base barrier panels increases the overall height of the base barrier panel from 36.00" to 42.00".

The present invention, in various embodiments, configurations, and aspects, includes components, methods, processes, systems, and/or apparatus substantially as depicted and described herein, including various embodiments, subcombinations, and subsets thereof. Those of skill in the art will understand how to make and use the present invention after understanding the present disclosure.

The present invention, in various embodiments, configurations, and aspects, includes providing devices and processes in the absence of items not depicted and/or described herein or in various embodiments, configurations, or aspects hereof, including in the absence of such items as may have been used in previous devices or processes, e.g., for improving performance, achieving ease, and/or reducing cost of implementation.

While the foregoing is directed to embodiments of the present disclosure, other and further embodiments of the present disclosure may be devised without departing from the basic scope thereof. It is understood that various embodiments described herein may be utilized in combination with any other embodiment described, without departing from the scope contained herein. Further, the foregoing description is not intended to be exhaustive or to limit the disclosure to the precise form disclosed.

Modifications and variations are possible in light of the above teachings or may be acquired from practice of the disclosure. Certain exemplary embodiments may be identified by use of an open-ended list that includes wording to indicate that the list items are representative of the embodiments and that the list is not intended to represent a closed list exclusive of further embodiments. Such wording may include "e.g.," "etc.," "such as," "for example," "and so forth," "and the like," etc., and other wording as will be apparent from the surrounding context.

What is claimed is:

1. A device for extending the height of a barrier comprising:

an elongate member comprising a top surface and a downward-facing rail channel configured for downward installation onto a first top rail of a base barrier panel, wherein said rail channel is defined by a solid member having longitudinal edges and a pair of opposed side walls extending downwardly from said longitudinal edges, said pair of opposed side walls having inner surfaces facing said rail channel;

wherein said inner surfaces comprise a plurality of pairs of opposed projections fully contained within the downward-facing rail channel, wherein the plurality of pairs of opposed projections project from said inner surfaces, respectively, and extend longitudinally along the inner surfaces and while protruding inwardly into the rail channel;

wherein a first pair of said opposed projections is situated at a position proximal to said solid member and configured to rest on an upward facing surface of a first top rail of a base barrier panel when said device is downwardly installed thereon; and wherein at least one further pair of said opposed projections is situated at a position distal to said solid member and configured to contact opposing sides of a first top rail of a base barrier panel when said device is downwardly installed thereon;

a decorative accent feature mounted on the top surface of the elongate member and extending upwardly therefrom; and a second top rail mounted to a top surface of the decorative accent feature and extending substantially the same length as the elongate member.

2. The device of claim 1, wherein both the solid member and the pair of opposed side walls are planar.

3. The device of claim 2, wherein the pair of opposed side walls are perpendicular to the solid member.

4. The device of claim 1, wherein the first pair of said opposed projections are planar and perpendicular to said inner surfaces.

5. The device of claim 1, wherein said inner surfaces comprise second and third pairs of said opposed projections, wherein the second pair is situated at a first position distal to the solid member and the third pair is situated at a second position distal to the solid member, wherein said second position is further from the solid member than said first position.

6. The device of claim 5, wherein said second and third pairs of opposed projections protrude inwardly into the rail channel at an upward angle.

7. The device of claim 6, wherein said third pair of opposed projections comprises upwardly flanged longitudinal edges distal from said inner surfaces.

8. The device of claim 7, wherein said upwardly flanged longitudinal edges are parallel to said inner surfaces.

9. The device of claim 1, wherein the decorative accent feature comprises one or more balusters.

10. The device of claim 9, wherein the decorative accent feature comprises two balusters.

11. The device of claim 9, wherein the decorative accent feature comprises three balusters.

12. The device of claim 9, wherein the one or more balusters comprises a square-shaped horizontal cross-section.

13. The device of claim 1, wherein the second top rail is configured to accept installation of a handrail cap.

14. The device of claim 1, wherein the configuration of the second top rail is identical that of the first top rail of the base barrier panel.

15. A system for extending the height of a barrier comprising:

a device according to claim 1;

a plurality of end covers, wherein each end cover is configured to cover at least a portion of an end of an elongate member when installed thereon while still allowing for downward installation of said device onto a first top rail of a base barrier panel; and a plurality of brackets, wherein each bracket is configured to secure the second top rail to a barrier post.

16. The system of claim 15, wherein the system further comprises a plurality of fasteners configured to secure a bracket to both the second top rail and a barrier post.

17. A method of installing a system for extending the height of a barrier, the method comprising the steps of:

providing a base barrier panel at least partially installed between two barrier posts, wherein the base barrier panel comprises a first top rail;

providing a system according to claim 15;

installing an end cover onto each end of the elongate member of said device;

downwardly installing the device from the installing step onto said first top rail such that the first pair of opposed projections rests on an upward facing surface of said first top rail and the at least one further pair of opposed projections contacts an opposing side of said first top rail; and securing each end of the second top rail to a barrier post via a bracket.

18. The method of claim 17, wherein prior to installing step, the method further comprises the steps of:

using a paper or plastic template to mark desired locations on each of the two barrier posts for installation of a bracket to which each end of the top rail of the device will be secured thereto, predrilling the desired marked locations on each barrier post, removing the template from the barrier posts, aligning each bracket with the predrilled holes on each post; and fastening each bracket to each post using fasteners.

19. The method of claim 17, wherein prior to the installing step, the method further comprises the steps of:

positioning the device of said system between said two barrier posts, adjusting the position of the device to achieve a desired spacing for said decorative accent feature, applying a mark to each end of said elongate member and each end of said second top rail at a point where they intersect with an inner edge of a barrier post, measuring from each mark toward the center of the device a distance sufficient to allow for bracket clearance to obtain a cut location; and cutting each end of said elongate member and each end of said second top rail at said cut location.

20. The method of claim 17, wherein prior to the securing step, the method further comprises the step of installing end covers onto each end of a handrail cap, followed by installing the handrail cap onto the top rail of the device.

* * * * *